US009739273B2

(12) United States Patent
Marquette et al.

(10) Patent No.: US 9,739,273 B2
(45) Date of Patent: Aug. 22, 2017

(54) ROTATABLE COMPONENT OVERSPEED PROTECTION METHOD

(71) Applicant: Caterpillar Inc., Peoria, IL (US)

(72) Inventors: Matthew S. Marquette, Peoria, IL (US); Jeffrey K. Berry, Yorkville, IL (US); Jason Brinkman, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 521 days.

(21) Appl. No.: 14/283,777

(22) Filed: May 21, 2014

(65) Prior Publication Data

US 2015/0337830 A1 Nov. 26, 2015

(51) Int. Cl.

| | |
|---|---|
| ***F04B 49/20*** | (2006.01) |
| ***F04B 49/06*** | (2006.01) |
| ***F04B 49/08*** | (2006.01) |
| ***F04B 49/12*** | (2006.01) |

(52) U.S. Cl.

CPC ..... *F04B 49/20* (2013.01); *F04B 49/065* (2013.01); *F04B 49/08* (2013.01); *F04B 49/12* (2013.01)

(58) Field of Classification Search

CPC ..... F04B 49/103; F04B 2201/1201; F04B 2203/1201; Y10T 74/1926

See application file for complete search history.

(56) References Cited

U.S. PATENT DOCUMENTS

| | | | | |
|---|---|---|---|---|
| 3,999,386 | A | 12/1976 | Crull et al. | |
| 5,435,131 | A * | 7/1995 | Hausman | F16H 61/425 60/327 |
| 5,576,962 | A | 11/1996 | Ferguson et al. | |
| 5,996,343 | A | 12/1999 | Kuras | |
| 6,073,442 | A | 6/2000 | Creger et al. | |
| 6,164,402 | A | 12/2000 | Hastreiter | |
| 6,684,635 | B2 | 2/2004 | Franz | |
| 7,693,642 | B2 * | 4/2010 | Anderson | B60K 6/12 701/50 |
| 7,798,277 | B2 | 9/2010 | Juricak et al. | |
| 8,738,241 | B2 | 5/2014 | Hague et al. | |
| 2002/0115531 | A1 * | 8/2002 | Degroot | F16H 61/16 477/92 |
| 2012/0310489 | A1 * | 12/2012 | Hague | F04B 49/02 701/50 |

* cited by examiner

*Primary Examiner* — Patrick Hamo

(74) *Attorney, Agent, or Firm* — James S. Bennin

(57) ABSTRACT

An overspeed protection method for a machine having an engine drivably coupled to a pump is disclosed. The method includes determining a speed of a rotatable component connected to the engine based on an engine speed and determining a minimum power limit based on the speed of the rotatable component. The minimum power limit corresponds to a minimum power required to retard the engine in order to prevent an overspeed condition of the rotatable component. The method further includes determining a minimum flow limit based on a predetermined relationship between the minimum power limit and the minimum flow limit. The minimum flow limit corresponds to a required flow of the pump in order to provide the minimum power limit. The method further includes regulating the pump in order to achieve the minimum flow limit.

19 Claims, 4 Drawing Sheets

ROTATABLE COMPONENT OVERSPEED PROTECTION METHOD

TECHNICAL FIELD

The present disclosure relates to an overspeed protection method, and more particularly to a rotatable component overspeed protection method.

BACKGROUND

Machines having work implements are provided with a plurality of implement pumps for supplying pressurized fluid to various actuators associated with the work implement. The plurality of implement pumps may be coupled with an internal combustion engine of the machine for receiving a power therefrom. Apart from the implement pumps, pumps for other machine components, such as a water pump, a steering pump, etc. may also be coupled with the internal combustion engine. When the machine is travelling downhill or decelerating, the ground engaging elements of the machine may drive the engine and increase an engine speed. This increased engine speed may also result in an increase in the speed of rotatable components connected to the engine, including the pumps.

US Patent Application Publication Number US 2012/0310489 discloses a machine having a pump overspeed protection system operating thereon. The machine includes an internal combustion engine, a plurality of ground engaging elements and a drivetrain coupling the internal combustion engine and the ground engaging elements. The drivetrain includes a torque converter having a locked configuration and an unlocked configuration. The machine also includes a plurality of pumps driven by the internal combustion engine. The machine further includes an electronic controller that is in communication with the internal combustion engine, the torque converter and the plurality of pumps. The electronic controller is configured to determine a pump speed of a first pump of the plurality of pumps and initiate a first action of a hierarchy of pump overspeed protection actions if the pump speed exceeds a first speed threshold. The electronic controller is further configured to initiate a second action of the hierarchy of pump overspeed protection actions if the pump speed exceeds a second speed threshold and initiate a third action of the hierarchy of pump overspeed protection actions if the pump speed exceeds a third speed threshold. The electronic controller is also configured to monitor a condition of a component altered by at least one of the hierarchy of pump overspeed protection actions. At least one of the hierarchies of pump overspeed protection actions includes increasing a displacement of at least one of the plurality of pumps and at least another of the hierarchy of pump overspeed protection actions includes moving the torque converter from the locked configuration to the unlocked configuration.

SUMMARY OF THE DISCLOSURE

In one aspect of the present disclosure, a rotatable component overspeed protection method for a machine having an engine drivably coupled to a pump is disclosed. The method includes determining a speed of a rotatable component connected to the engine based on an engine speed and determining a minimum power limit based on the speed of the rotatable component. The minimum power limit corresponds to a minimum power required to retard the engine in order to prevent an overspeed condition of the rotatable component. The method further includes determining a minimum flow limit based on a predetermined relationship between the minimum power limit and the minimum flow limit. The minimum flow limit corresponds to a required flow of the pump in order to provide the minimum power limit. The method further includes regulating the pump in order to achieve the minimum flow limit.

In another aspect of the present disclosure, a rotatable component overspeed protection method for a machine having an engine drivably coupled to a pump is disclosed. The method includes determining a speed of a rotatable component connected to the engine based on an engine speed and determining a minimum power limit based on the speed of the rotatable component. The minimum power limit corresponds to a minimum power required to retard the engine to prevent an overspeed condition of the rotatable component. The method further includes determining a minimum flow limit based on a predetermined map between estimated values of the minimum power limit and estimated values of a minimum flow limit. The minimum flow limit corresponds to a required flow of the pump in order to provide the minimum power limit. The method further includes changing the displacement of the pump in order to achieve the minimum flow limit.

In yet another aspect of the present disclosure, a machine is disclosed. The machine includes an engine and a pump. The pump is drivably coupled to the engine. The machine further includes a controller in communication with the engine and the pump. The controller is configured to determine a maximum desired speed of a rotatable component connected to the engine and determine a minimum power limit based on the maximum desired speed of the rotatable component. The minimum power limit corresponds to a minimum power required to retard the engine in order to prevent the rotatable component from rotating at a speed greater than the maximum desired speed. The controller is further configured to determine a minimum flow limit based on a predetermined relationship between the minimum power limit and the minimum flow limit. The minimum flow limit corresponds to a required flow of the pump to provide the minimum power limit. The controller is further configured to regulate the pump in order to achieve the minimum flow limit.

Other features and aspects of this disclosure will be apparent from the following description and the accompanying drawings.

DETAILED DESCRIPTION

Figure 1:
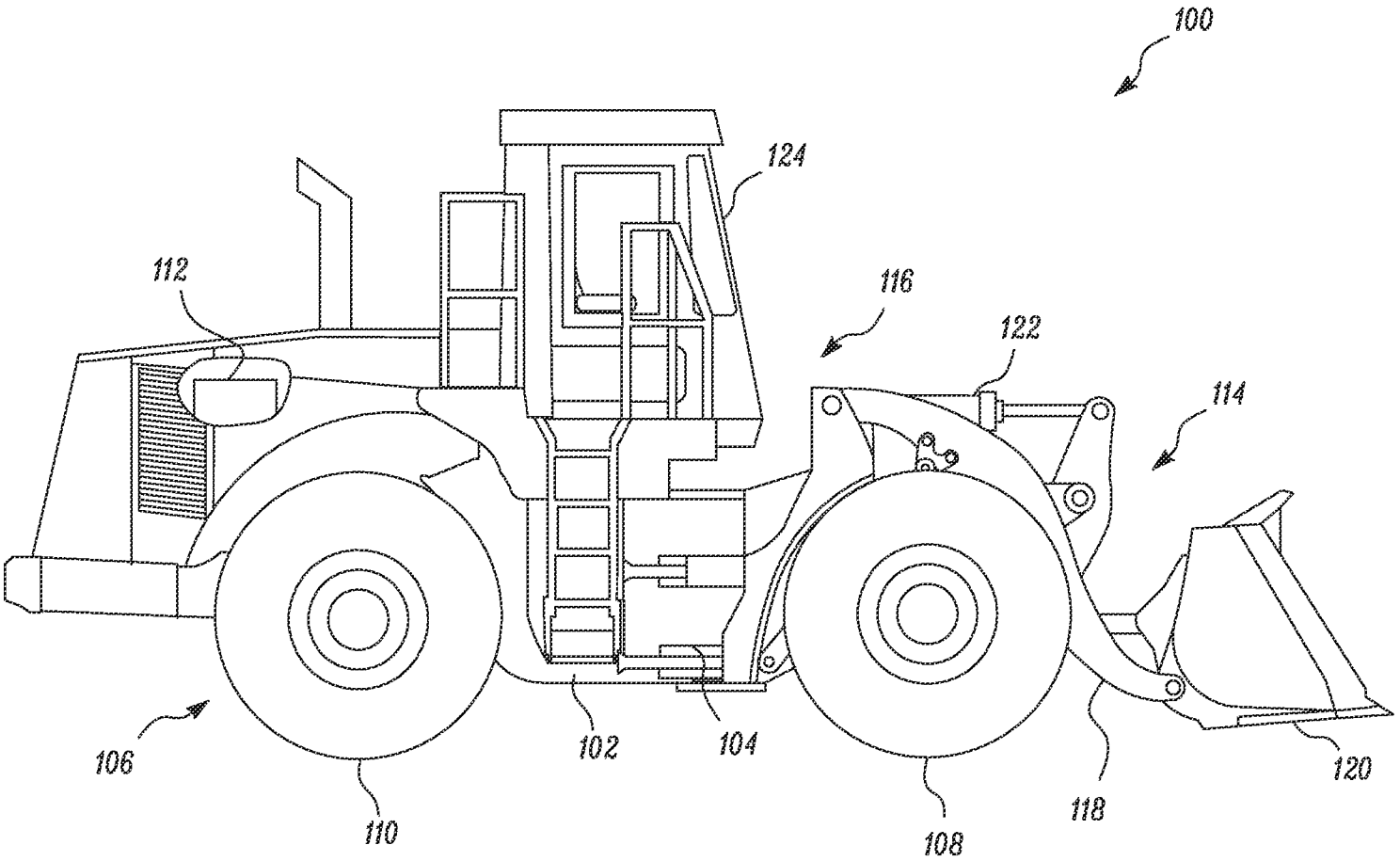
FIG. 1 illustrates a side view of an exemplary machine, according to an embodiment of the present disclosure.

FIG. 1 illustrates an exemplary machine 100, according to an embodiment of the present disclosure. In the illustrated embodiment, the machine 100 is a wheel loader. However, in various other embodiments, the machine 100 may be any other on-highway or off-highway vehicle. The machine 100 may also be associated with a work implement to perform various earth moving operations. The machine 100 includes a machine body 102 having a drivetrain 104 supported thereon for driving ground engaging members 106 of the machine 100. The ground engaging members 106 may be, for example, wheels, tracks, etc. In the embodiment of FIG. 1, the ground engaging members 106 include front wheels 108 and rear wheels 110. The drivetrain 104 includes an internal combustion engine 112 that provides power to various other components of the drivetrain 104, such as, for example, transmission shaft, axles and the ground engaging members 106. The engine 112 may be run by fuels such as, for example, diesel, gasoline, a gaseous fuel, or a combination thereof. The engine 112 may include a single cylinder or a plurality of cylinders. The plurality of cylinders may be in various configurations such as, for example, inline, V-type, etc. In other embodiments, the drivetrain 104 may be an electric drive that electrically drives the ground engaging members 106 via one or more motors (not shown). The motors may receive electrical power from an engine driven generator set or an electrical power source (e.g., a battery) via electric drive components including, but not limited to, an inverter and a rectifier.

The engine 112 may also provide power to one or more work implements 114, such as a loader. The loader is attached to the machine body 102 at a front end 116 thereof. The loader includes a pair of arms 118 having one end that may be pivotally attached to the front end 116 of the machine body 102. The pair of arms 118 may be tilted upward and downward with respect to a pivotal point provided at the front end 116 of the machine 100. A bucket 120 is pivotally coupled with other end of the pair of arms 118 for performing various earth moving operations and alike. The machine 100 may also include one or more hydraulic actuators. One hydraulic actuator 122 is disposed at the front end 116 of the machine 100 for actuating the loader, such as, for example, lifting or lowering the pair of arms 118 and thereby the bucket 120. The hydraulic actuator 122 is hereinafter referred as 'the lift cylinder 122'. The lift cylinder 122 may be a hydraulic cylinder having a piston slidably disposed therein. A free end of the hydraulic cylinder may be pivotally coupled with the front end 116 of the machine 100 and free end of the piston is pivotally coupled with the pair of arms 118 to actuate the loader.

The machine 100 also includes an operator cab 124 that may be mounted on the machine body 102. The operator cab 124 may include various machine operating controllers. For example, the machine operating controllers may include hand operated levers for controlling a work implement 114 of the machine 100. Further, the machine operating controller may include one or more pedals and levers for controlling movement of the machine 100, such as forward, neutral, or reverse direction. The operator cab 124 may also include an engine speed selection device, such as a throttle for selecting a speed of the engine 112. The operator cab 124 may also include additional or different machine operating controllers for operating various components associated with the drivetrain 104 and work implement 114 of the machine 100.

Figure 2:
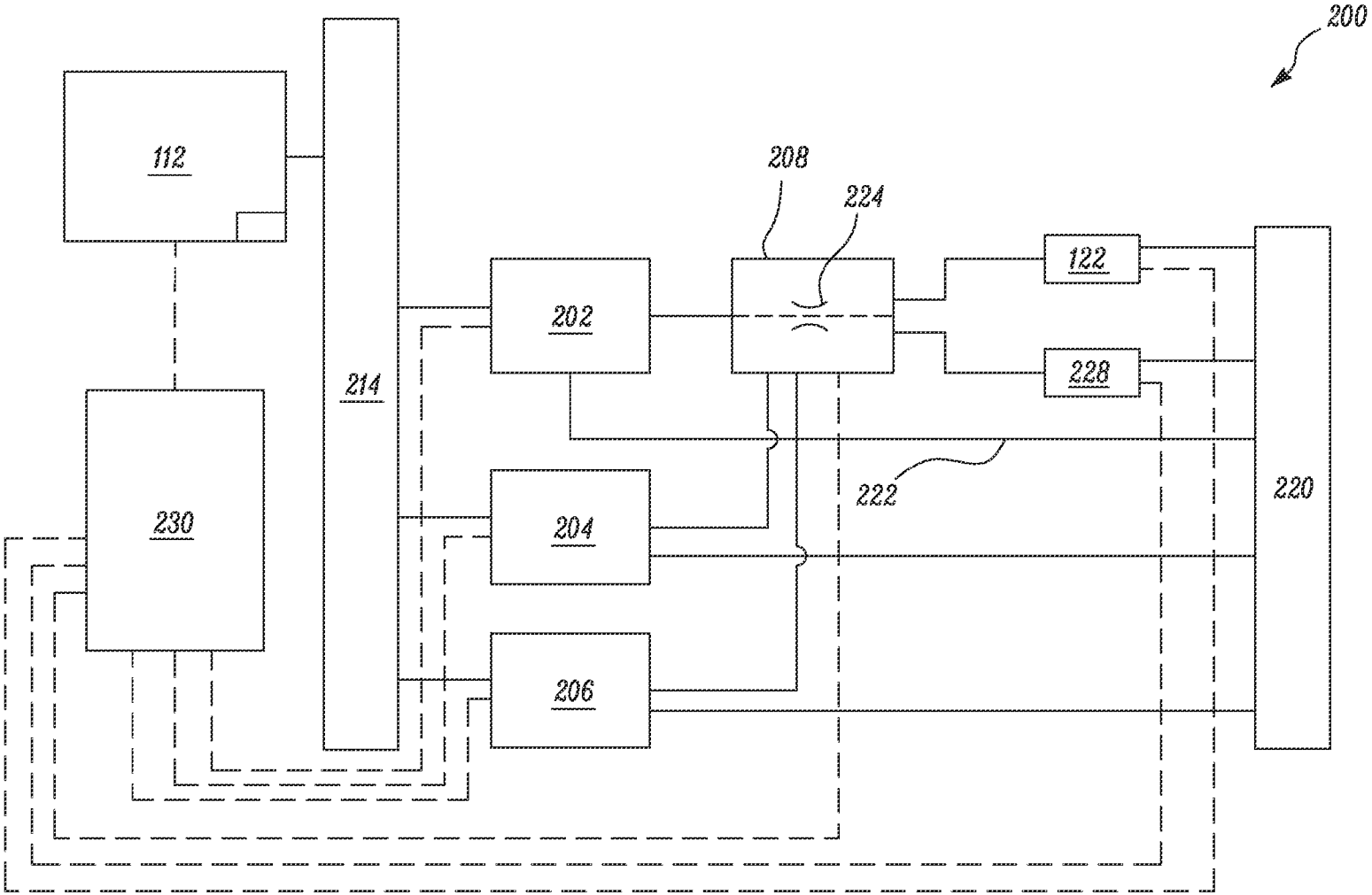
FIG. 2 is a block diagram illustrating an exemplary hydraulic system of the machine, according to an embodiment of the present disclosure.

FIG. 2 shows a block diagram illustrating an exemplary hydraulic system 200 of the machine 100, according to an embodiment of the present disclosure. The hydraulic system 200 may include one or more implement pumps. For the purpose of illustration, the hydraulic system 200 in the embodiment of FIG. 2, may include a first implement pump 202, a second implement pump 204 and a third implement pump 206. Each of the first, second and third implement pumps 202, 204, 206 may be a variable displacement pump having a swash plate. A position of each swash plate within each implement pump may be adjusted to various inclinations to vary flow of a fluid from the pumps. The hydraulic system 200 may further include a valve 208 that may be in fluid communication with the first implement pump 202, the second implement pump 204 and the third implement pump 206. The valve 208 may be an electrically actuated pressure regulator valve. The valve 208 may include an actuator, such as a solenoid communicably coupled with a controller 230 for receiving control signals therefrom. Upon receipt of a control signal from the controller 230, the actuator actuates the valve 208 and further fluidly communicates with the implement pumps 202, 204, 206. The valve may be further in fluid communication with the hydraulic actuators.

The first, second and third implement pumps 202, 204, 206 may be drivably coupled with the engine 112 of the machine 100 for receiving a power therefrom. One of ordinary skill in the art will recognize that other rotatable components such as gears or other drivetrain components may be connected to the engine. Moreover, it may be desirable to limit a maximum speed of these other rotatable components, just as it may be desirable to limit the speed of the implement pumps. In the embodiment of FIG. 2, each of the implement pumps is coupled with the engine 112 via a gear drive 214. The gear drive 214 may include a first gear (not shown) that may be operatively coupled with the engine 112. The gear drive 214 may further include a second gear (not shown) that may be operatively coupled with the implement pumps 202, 204, 206. In various other embodiments, the implement pumps may be drivably coupled with the engine 112 via, for example, a belt drive or a chain drive.

The first, second and third implement pumps 202, 204, 206 may be further fluidly coupled with a fluid source 220 via an input line 222 to receive the fluid therefrom. The fluid source 220 may be a tank disposed at a desired location in the machine body 102. The first, second and third implement pumps 202, 204, 206 may be communicably coupled with the controller 230 to receive a control signal therefrom. Upon receipt of the control signal, the implement pumps 202, 204, 206 may receive the fluid via the input line 222 from the fluid source 220 and discharge the pressurized fluid to the one or more hydraulic actuators of the machine 100 via the valve 208. The valve 208 may include an orifice member 224. The orifice member 224 may have a fixed size opening to allow the pressurized fluid to flow therethrough. In an embodiment, the valve 208 may be a pressure relief valve configured to provide fluid to the hydraulic actuators at a predetermined pressure.

In the embodiment of FIG. 2, the hydraulic actuators may include the lift cylinder 122 and a tilt cylinder 228. The tilt cylinder 228 may be coupled to the bucket 120. The tilt cylinder 228 may be configured to rotate the bucket 120 relative to the arms 118 (shown in FIG. 1). The lift cylinder 122 and the tilt cylinder 228 may be in fluid communication with the valve 208 to receive the pressurized fluid therethrough. The lift cylinder 122 and the tilt cylinder 228 may be in fluid communication with the valve 208 via respective control valves (not shown) for selectively actuating the respective cylinders 122, 228. Each of the control valves may control the flow of the pressurized fluid to the lift cylinder 122 and the tilt cylinder 228 so as to control the movement of the pair of arms 118 and the bucket 120, respectively, of the loader. The valve 208 may supply pressurized fluid to the lift cylinder 122 and the tilt cylinder 228 in response to input received from the controller 230.

In various other embodiments, the hydraulic system 200 may include additional pumps, valves and hydraulic actuators for controlling various functions of the machine 100. The additional pumps may include, for example, a steering pump, a lubricating oil pump, water pump, and other known pumps for supplying fluid to respective components such as hydraulic cylinders associated with a power steering system, an engine lubrication system and an engine cooling system.

In an embodiment, the controller 230 may include a central processing unit, a memory and an input/output circuit that facilitates communication of the controller 230 with the hydraulic system 200. One skilled in the art will appreciate that a computer based system or a device that utilizes similar components may be configured for use with the present disclosure. The controller 230 may be communicably coupled with various components of the hydraulic system 200 and the machine 100 via one or more communications lines. In the embodiment of FIG. 2, the controller 230 may be electronically communicated with the engine 112 for controlling various functions of the engine 112 such as, for example, throttling, fuel injection etc. The controller 230 may also be communicably coupled with the first, second and third implement pumps 202, 204, 206 to control various inclined positions of the swash plates thereof so as to vary displacement of the fluid.

Figure 3:
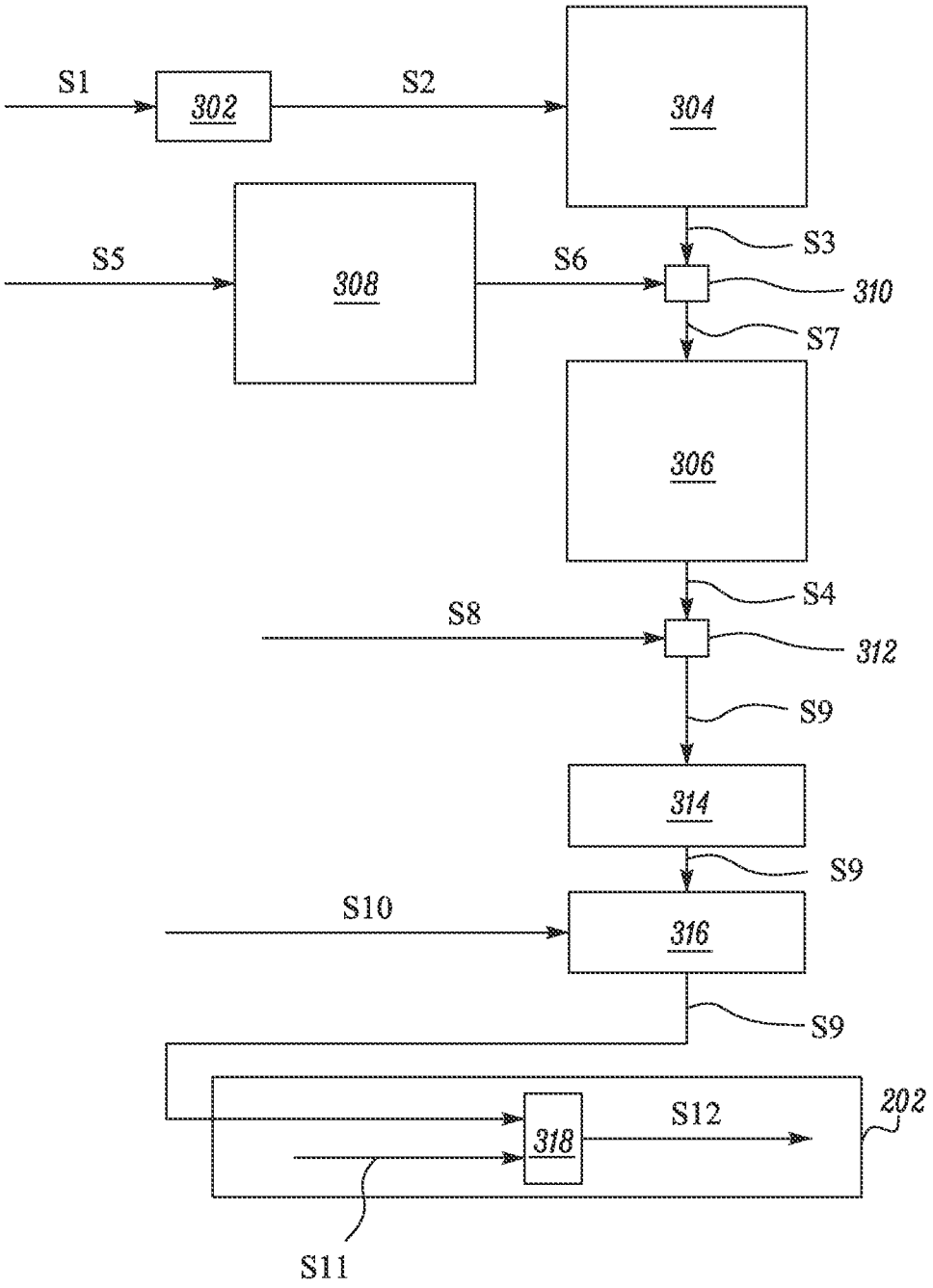
FIG. 3 is a logical block diagram for rotatable component overspeed protection, according to an embodiment of the present disclosure.

FIG. 3 shows a logical block diagram for rotatable component overspeed protection, according to an embodiment of the present disclosure. The controller 230 (shown in FIG. 2) may implement various steps illustrated in the FIG. 3. The controller 230 may be electronically communicated with the engine 112 to monitor an engine speed S1. The controller 230 may be communicated with any rotary part of the engine 112 such as, for example, flywheel or crankshaft to determine the engine speed S1. The engine speed S1 is communicated to a rotatable component speed processing module 302. The rotatable component speed processing module 302 may be provided with a gear drive ratio. The gear drive ratio may correspond to a ratio of the gear drive 214 that is disposed between the engine 112 and the implement pumps 202, 204, 206. The gear drive ratio may be determined based on either the number of teeth or outer diameter of the first gear that is coupled with the engine 112 and the second gear that is coupled with the implement pumps 202, 204, 206. Upon receipt of the engine speed S1 from the controller 230, the rotatable component speed processing module 302 may multiply the engine speed S1 with the gear drive ratio and output a speed of the rotatable component S2. Alternatively, the rotatable component speed S2 may be determined based on the engine speed S1 by using a map, a lookup table, a mathematical equation, and so on.

The rotatable component speed S2, as determined by the rotatable component processing module 302, may be communicated to a first reference map 304. The first reference map 304 may be defined based on a relationship between a speed of the rotatable component and a minimum power limit. The minimum power limit is the amount of power that is needed to slow the engine down to a desired maximum speed, or at least prevent the engine from rotating at a speed greater than the desired maximum speed. Any rotatable component connected to the engine may be characterized by a maximum desirable speed of rotation. Various implementations of the disclosure may prevent the speed of the rotatable component from exceeding a threshold by providing sufficient power to limit the speed of rotation of the engine. Upon determination of the maximum desirable speed S2 for the rotatable component, the first reference map 304 may be referred to for determination of a minimum power limit S3 corresponding to the rotatable component speed S2. The minimum power limit S3 corresponds to a minimum power that is required to retard the engine 112 in order to prevent an overspeed condition of the rotatable component. In various implementations of this disclosure, the rotatable component may be one or more of the first, second and third implement pumps 202, 204, 206. Additionally or in the alternative, the displacement of one or more of the pumps may be controlled in order to provide the minimum power required to retard the engine and prevent overspeed of the rotatable component. The minimum power may also be utilized to retard the engine 112 when the machine 100 is travelling down a grade.

In various implementations, a second reference map 308 may be used. The second reference map 308 may be defined based on a relationship between temperature of the fluid that is used with a pump, and various scaling factors. The temperature of the fluid may become a factor when the displacement of the pump is changed in order to generate the minimum power limit. An increase in the displacement of the pump may generate the power that is required to retard the engine, but may at the same time result in an excessive increase in the temperature of the fluid. The second reference map 308 may receive a temperature S5 of the fluid from the controller 230. The controller 230 may determine the temperature S5 based on a signal from a temperature sensor associated with the fluid. Upon receipt of the temperature S5 of the fluid, the second reference map 308 may be used to determine a scaling factor S6 corresponding to the temperature S5 of the fluid. The scaling factor S6 may be further communicated with a first multiplier 310. The scaling factor S6 may be configured to reduce the minimum power limit S3 based on the temperature S5 to prevent overheating of the fluid. In various examples, the scaling factor S6 may be a percentage value or a fractional value. The first multiplier 310 may be further communicated with the first reference map 304 to receive the minimum power limit S3. Upon receipt of the scaling factor S6, the first multiplier 310 multiplies the minimum power limit S3 with the scaling factor S6 to provide a modified power limit S7. The modified power limit S7 may be equal to or less than the minimum power limit S3. Further, the modified power limit S7 may be the value of pump power that may be used to retard the engine 112 to prevent the overspeed condition of the pump without causing overheating of the fluid.

The modified power limit S7 from the first multiplier 310 may be communicated to a predetermined map 306. The predetermined map 306 may be defined based on a relationship between estimated values of minimum power limit and estimated values of minimum flow limit. The estimated values of the minimum power limit and the estimated values of the minimum flow limit may be further determined based on a relationship between a pressure and a fluid flow generated by the orifice member 224 since the fluid from the implement pumps 202, 204, 206 flows through the orifice member 224. Therefore, the pressure generated by each of the first, second, third implement pumps 202, 204, 206 may be estimated based on a given fluid flow. In an example, a pump power may be equal to a product between pump flow and pump pressure. Thus, the relationship between pump power and pump flow may be predetermined and sensing pump pressure during operation of the hydraulic system 200 is not required.

Upon receipt of the modified power limit S7, the predetermined map 306 determines a minimum flow limit S4 based on the predetermined relationship between the minimum power limit and the minimum flow limit. The minimum flow limit S4 may correspond to a required flow generated by one or more of the implement pumps 202, 204, 206 in order to provide the modified power limit S7. The minimum power limit S3 may be directly communicated to the predetermined map 306 without being multiplied by the scaling factor S6, and the minimum flow limit S4 may be determined based on the minimum power limit S3.

The minimum flow limit S4 may be determined based on either of the minimum power limit S3 or the modified power limit S7 by various alternative methods within the scope of the present disclosure. For example, instead of the predetermined map 306, a lookup table, a mathematical equation, a regression based model or the like, may be used to determine the minimum flow limit S4. Such alternative methods may also be based on the relationship between estimated values of minimum power limit and estimated values of minimum flow limit.

The controller 230 may further determine a total maximum flow S8 of the fluid that may be generated by the plurality of implement pumps, including the first, second and third implement pumps 202, 204, 206. The total maximum flow S8 may be calculated by individually determining a maximum flow of the fluid that may be generated by each of the first, second and third implement pumps 202, 204, 206. The maximum flow of each of the first, second and third implement pumps 202, 204, 206 may be added to determine the maximum flow S8. The maximum flow through each of the first, second and third implement pumps 202, 204, 206 may be determined based on the engine speed S1 and a maximum displacement of each of the first, second and third implement pumps 202, 204, 206. For example, the maximum flow of fluid through an implement pump may be calculated by multiplying speed of the implement pump, displacement of the implement pump, and a pump efficiency value. The speed of the implement pump may be calculated based on the speed of the engine 112. The maximum flow S8 of the fluid of the plurality of implement pumps may be communicated to a second multiplier 312. The second multiplier 312 is further communicated with the predetermined map 306 to receive the minimum flow limit S4.

The controller 230 may further determine a minimum displacement command limit S9 for each of the implement pumps 202, 204, 206 as a ratio between the minimum flow limit S4 and the maximum flow S8 of the fluid of the plurality of implement pumps. The minimum displacement command limit S9 may be determined as a fraction or a percentage.

As shown in FIG. 3, the minimum displacement command limit S9 is communicated to a rate limit module 314. The rate limit module 314 may be configured to limit a rate of change of the displacement of each of the plurality of implement pumps within a predetermined threshold. This may prevent pressure spikes in the hydraulic system 200 due to application of the overspeed protection method. In an embodiment, the rate limit module 314 may limit the rate of increase of the pump displacement as well as a subsequent rate of decrease of the pump displacement. The predetermined threshold for the rate of change of the pump displacement may be defined as a rate limited command limit. If the rate of change of the minimum displacement command limit S9 is higher than the rate limited command limit, then the rate limit module 314 may limit the rate of change within the rate limited command limit.

An override control module 316 is communicated with the controller 230. The override control module 316 may set the minimum displacement command limit S9 to zero based on an operator command S10. Thus, the override control module 316 may prevent the pump overspeed protection strategy from running when a normal operation of the work implements 114 is desired. This may at least partly reduce instability during operation of the working implements 114.

A comparator 318 may be in communication with the override control module 316 to receive the minimum displacement command limit S9. In the embodiment of FIG. 3, the comparator 318 may be associated with the first implement pump 202. The comparator 318 receives the minimum displacement command limit S9 and a pump command S11. The pump command S11 may be based on the operator command S10. Further, the comparator 318 compares the minimum displacement command limit S9 with the pump command S11, and provides a final pump command S12 to the first implement pump 202. The final pump command S12 may be a maximum between the minimum displacement command limit S9 and the pump command S11. Thus, the displacement of the first implement pump 202 may be changed by the final pump command S12. Similarly, the implement pumps 204, 206 may also be connected to corresponding comparators (not shown). The comparators 318 may receive the minimum displacement command limit S9 and pump commands for the respective implement pumps and provide final pump commands to the corresponding implement pumps 204, 206.

The rotatable component protection strategy, as described with reference to FIG. 3, may be applicable to the implement pumps 202, 204, 206 as well as other pumps of the machine 100, for example, the steering pump, the lubricating oil pump, the water pump, and the like. Additionally or in the alternative, the protection strategy may be used to limit the speed of other rotating components connected to the engine such as gears and other drivetrain components.

INDUSTRIAL APPLICABILITY

Machines include pumps for operating various systems of the machine. The pumps may be driven by an engine of the machine. The engine may experience a resistive load from ground engaging elements of the machine while the machine is travelling down a grade or decelerating. In such conditions, the resistive load may drive the engine and increase an engine speed. This increased engine speed may be above the normal speed range for the engine and may cause rotatable components connected to the engine to also rotate at speeds in excess of desirable threshold speeds. If the engine speed is allowed to continue to increase beyond a threshold, or maintain speeds in excess of the threshold, components connected to the engine may experience wear or even failure.

The present disclosure relates to a rotatable component overspeed protection method and a machine using the same. The method includes changing the displacement of one or more of a plurality of implement pumps 202, 204, 206 to apply the minimum power limit S3 on the engine 112 in order to retard the engine 112. The minimum power limit S3 is selected from the first reference map 304 based on the speed S2 of the rotatable component. Further, the predetermined map 306 is used for determining the minimum flow limit S4 based on the minimum power limit S3. The minimum displacement command limit S9 may be applied to one or more of the plurality of implement pumps to achieve the minimum flow limit S4. Retarding the engine 112 may prevent damage to the engine 112, the implement pumps and other associated rotatable components, such as the steering pump, the lubricating oil pump, and the water pump. With use of the predetermined map 306 based on the predetermined relationship between the minimum power limit and the minimum flow limit, displacement of each of the pumps may be regulated to improve stability during implementation of the rotatable component overspeed protection method.

Figure 4:
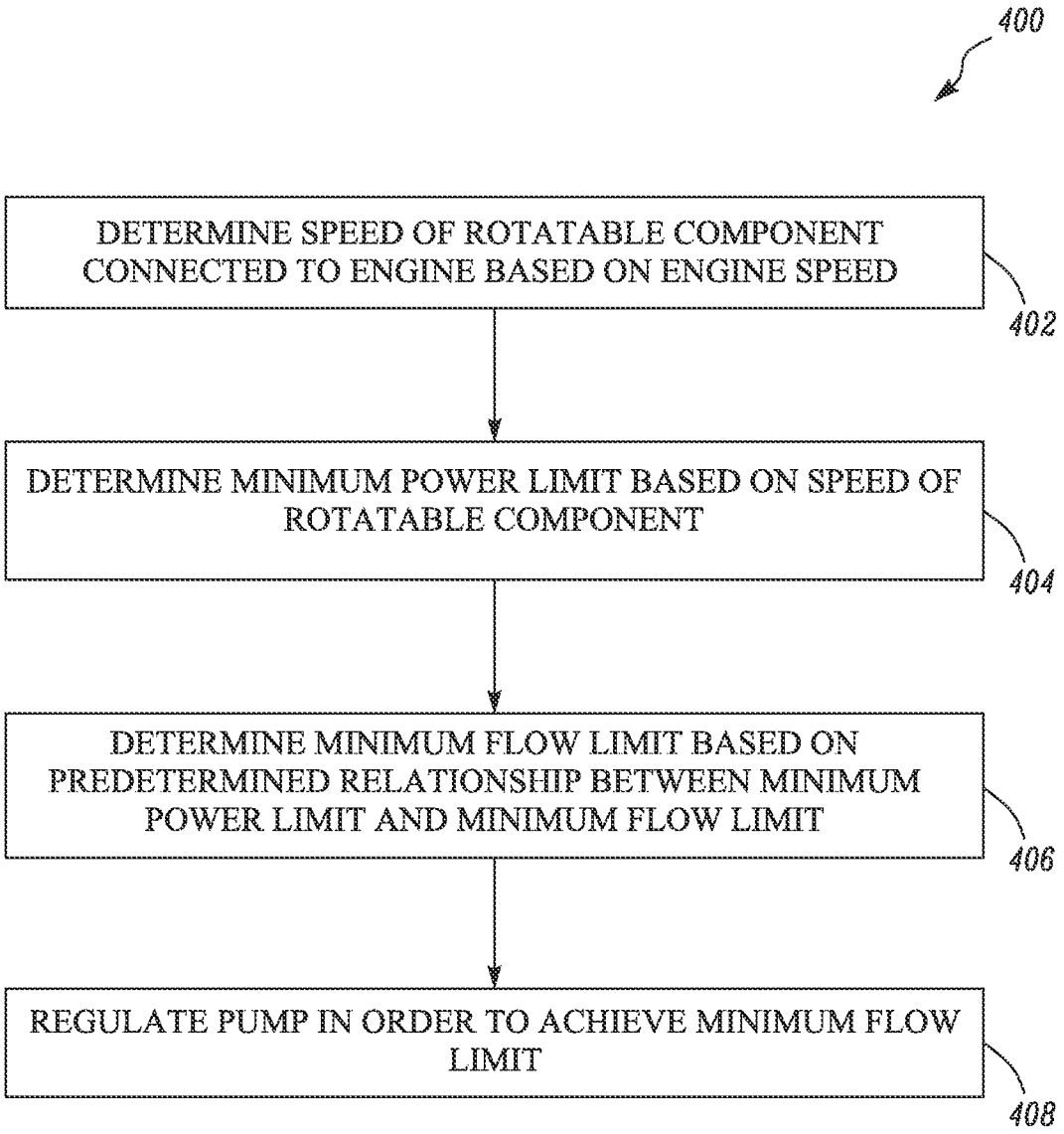
FIG. 4 is a flow diagram illustrating a method of rotatable component overspeed protection in the machine, according to an embodiment of the present disclosure.

FIG. 4 shows a flow diagram illustrating a rotatable component overspeed protection method 400, according to an embodiment of the present disclosure. The method 400 includes a step 402 for determining the speed S2 of a rotatable component connected to the engine based on the engine speed S1. The controller 230 monitors the engine speed S1 and communicates the engine speed S1 to the rotatable component speed processing module 302. Upon receipt of the engine speed S1, the rotatable component speed processing module 302 may multiply the engine speed S1 with the gear drive ratio and output the speed S2 of the rotatable component.

The method further includes a step 404 for determining the minimum power limit S3 based on the speed S2 of the rotatable component. The speed S2, as determined by the rotatable component speed processing module 302, is communicated to the first reference map 304. Upon receipt of the speed S2, the first reference map 304 may determine the minimum power limit S3 corresponding to the speed S2 of the rotatable component. The minimum power limit S3 corresponds to the minimum power that is required to retard the engine 112 in order to prevent the overspeed condition of the rotatable component.

In various other implementations, the method 400 may also include determining the modified power limit S7. The controller 230 may communicate the temperature S5 of the fluid to the second reference map 308. Upon receipt of the temperature S5 of the fluid, the second reference map 308 determines the scaling factor S6 corresponding to the temperature S5 of the fluid. The scaling factor S6 may be further communicated with the first multiplier 310. Upon receipt of the scaling factor S6, the first multiplier 310 may multiply the minimum power limit S3 with the scaling factor S6 to provide the modified power limit S7.

The method 400 further includes a step 406 for determining the minimum flow limit based on the predetermined relationship between the minimum power limit and the minimum flow limit. The relationship between the minimum power limit and the minimum flow limit includes the predetermined map 306. The predetermined map 306 may be defined based on the relationship between the estimated values of minimum power limit and the estimated values of minimum flow limit. The estimated values of the minimum power limit and the estimated values of the minimum flow limit are determined based on the relationship between the pressure and the fluid flow generated by the orifice member 224. The minimum power limit S3 is communicated to the predetermined map 306. Upon receipt of the minimum power limit S3, the predetermined map 306 determines the minimum flow limit S4. The minimum flow limit S4 corresponds to the required flow of the first, second and third implement pumps 202, 204, 206 in order to provide minimum power required to retard the engine 112. This may prevent the overspeed condition of the rotatable component. Alternatively, the predetermined map 306 may also determine the minimum flow limit S4 based on the modified power limit S7. The method 400 may not require sensing pump pressures of the implement pumps 202, 204 and 206. When an instantaneous pressure is used to determine a required displacement of the pumps to achieve the minimum power limit, and the instantaneous pressure is lower than a relief pressure of the valve 208, the estimated displacement may be inaccurate. This inaccuracy may be due to a lag between the instantaneous pressure and the subsequent determination of the displacement of the pumps. Further, the pressure and the flow through the orifice member 224 are related, and changing the flow may also alter the pressure. Therefore, the pump pressure is estimated beforehand based on the relationship between the pressure and the fluid flow generated by the orifice member 224 and the predetermined map 306 formulated accordingly. Consequently, the method 400 may prevent instabilities which may arise due detection of instantaneous pressure.

The method 400 further includes determining the total maximum flow S8 of the fluid through the plurality of implement pumps, including first, second and third implement pumps 202, 204, 206. The total maximum flow S8 of the fluid through the plurality of implement pumps may include determining maximum flow of the fluid through each of the first, second and third implement pumps 202, 204, 206 based at least on the engine speed S1 and a maximum displacement of the implement pump. The maximum flow of fluid through each of the implement pumps may be added together to determine the total maximum flow S8. The total maximum flow S8 may be communicated to the second multiplier 312. The second multiplier 312 also receives the minimum flow limit S4 and determines the minimum displacement command limit S9 based on the ratio between the minimum flow limit S4 and the total maximum flow S8.

The method 400 may include limiting the rate of change of the minimum displacement of the pump within the predetermined threshold. The minimum displacement command limit S9 is communicated to the rate limit module 314. The predetermined threshold command limit for the rate of change of the pump displacement may be defined as the rate limited command limit. If the rate of change of the minimum displacement command limit S9 is higher than the rate limited command limit, then the rate limit module 314 may limit the rate of change within the rate limited command limit. The rate of change of displacement command limit may be limited within the predetermined threshold to stabilize the minimum displacement command limit S9 applied on each of the plurality of pumps.

The method 400 may further include setting the minimum displacement command limit S9 to zero based on the operator command S10. This may prevent the rotatable component overspeed protection method from running when a normal operation of the work implements 114 is desired. This may at least partly reduce instability during operation of the work implements 114.

The method 400 further includes a step 408 for regulating the pump in order to achieve the minimum flow limit S4. Each of the implement pumps may be regulated by changing the displacement of the pump to achieve the minimum flow limit S4. The minimum displacement command limit S9 for each of the plurality of implement pumps 202, 204, 206 may be communicated with individual comparators, for example, the comparator 318 for the first implement pump 202. The pump command S11 for the first implement pump 202 is also communicated to the comparator 318. The comparator 318 compares both the minimum displacement command limit S9 and the pump command S11 and provides the final pump command S12 to the first implement pump 202. Thus, the displacement of the first implement pump 202 may be changed by the respective final pump command S12. The same procedure may also be utilized for determining the final pump commands for the second and third implement pumps 204, 206.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A rotatable component overspeed protection method for a machine having an engine drivably coupled to a pump, the method comprising:

determining a speed of a rotatable component connected to the engine based on an engine speed;

determining a minimum power limit based on the speed of the rotatable component, wherein the minimum power limit corresponds to a minimum power required to retard the engine to prevent an overspeed condition of the rotatable component;

determining a minimum flow limit based on a predetermined map between estimated values of the minimum power limit and estimated values of a minimum flow limit, wherein the minimum flow limit corresponds to a required flow of the pump in order to provide the minimum power limit, and wherein the estimated values of the minimum power limit and the estimated values of the minimum flow limit are determined based on a relationship between a pressure and a fluid flow generated by an orifice member in fluid communication with the pump; and changing a displacement of the pump in order to achieve the minimum flow limit.

2. The method of claim 1, further comprising:

determining a scaling factor based on a temperature of a fluid used with the pump;

multiplying the minimum power limit with the scaling factor to obtain a modified power limit; and determining the minimum flow limit based on the modified power limit.

3. The method of claim 1, further comprising:

determining a maximum flow through the pump based on the engine speed and a maximum displacement of the pump;

determining a minimum displacement command limit as a ratio between the minimum flow limit and the maximum flow; and changing the displacement of the pump by the minimum displacement command limit.

4. The method of claim 1, wherein a plurality of pumps are drivably coupled to the engine, and wherein the method of claim 1 further comprising:

determining a maximum flow through each respective pump of the plurality of pumps based on the engine speed and a maximum displacement of the respective pump;

adding the maximum flow of each of the plurality of pumps to obtain a total maximum flow;

determining a minimum displacement command limit as a ratio between the minimum flow limit and the total maximum flow; and changing the displacement of each respective pump of the plurality of pumps by the minimum displacement command limit.

5. The method of claim 1, further comprising limiting a rate of change of a displacement of the pump within a predetermined threshold.

6. A rotatable component overspeed protection method for a machine having an engine drivably coupled to a pump, the method comprising:

determining a speed of a rotatable component connected to the engine based on an engine speed;

determining a minimum power limit based on the speed of the rotatable component, wherein the minimum power limit corresponds to a minimum power required to retard the engine in order to prevent an overspeed condition of the rotatable component;

determining a minimum flow limit based on a predetermined relationship between the minimum power limit and the minimum flow limit, wherein the minimum flow limit corresponds to a required flow of the pump in order to provide the minimum power limit; regulating the pump in order to achieve the minimum flow limit; and limiting a rate of change of a displacement of the pump within a predetermined threshold.

7. The method of claim 6, wherein the predetermined relationship between the minimum power limit and the minimum flow limit comprises a predetermined map between estimated values of the minimum power limit and estimated values of the minimum flow limit.

8. The method of claim 7, wherein the estimated values of the minimum power limit and the estimated values of the minimum flow limit are determined based on a relationship between a pressure and a fluid flow generated by an orifice member in fluid communication with the pump.

9. The method of claim 6, further comprising:

determining a scaling factor based on a temperature of a fluid used with the pump;

multiplying the minimum power limit with the scaling factor to obtain a modified power limit; and determining the minimum flow limit based on the modified power limit.

10. The method of claim 6, wherein regulating the pump comprises changing the displacement of the pump.

11. The method of claim 6, further comprising:

determining a maximum flow through the pump based on the engine speed and a maximum displacement of the pump;

determining a minimum displacement command limit as a ratio between the minimum flow limit and the maximum flow; and changing the displacement of the pump by the minimum displacement command limit.

12. The method of claim 6, wherein a plurality of pumps is drivably coupled to the engine, and wherein the method of claim 6 further comprising:

determining a maximum flow through each respective pump of the plurality of pumps based on the engine speed and a maximum displacement of the respective pump;

adding the maximum flow of each of the plurality of pumps to obtain a total maximum flow;

determining a minimum displacement command limit as a ratio between the minimum flow limit and the total maximum flow; and changing the displacement of each respective pump of the plurality of pumps by the minimum displacement command limit.

13. The method of claim 12, further comprising setting the minimum pump displacement command limit to zero based on an operator command.

14. A machine comprising:

an engine;

a pump drivably coupled to the engine; and a controller in communication with the engine and the pump, the controller configured to:

determine a maximum desired speed of a rotatable component connected to the engine;

determine a minimum power limit based on the maximum desired speed of the rotatable component, wherein the minimum power limit corresponds to a minimum power required to retard the engine in order to prevent the rotatable component from rotating at a speed greater than the maximum desired speed;

determine a minimum flow limit based on a predetermined relationship between the minimum power limit and the minimum flow limit, wherein the minimum flow limit corresponds to a required flow of the pump to provide the minimum power limit;

regulate the pump in order to achieve the minimum flow limit; and limit a rate of change of a displacement of the pump within a predetermined threshold.

15. The machine of claim 14, wherein the predetermined relationship between the minimum power limit and the minimum flow limit comprises a predetermined map between estimated values of the minimum power limit and estimated values of the minimum flow limit.

16. The machine of claim 15, wherein the estimated values of the minimum power limit and the estimated values of the minimum flow limit are determined based on a relationship between a pressure and a fluid flow generated by an orifice member in fluid communication with the pump.

17. The machine of claim 14, wherein the controller is further configured to:

determine a scaling factor based on a temperature of a fluid used with the pump;

multiply the minimum power limit with the scaling factor to obtain a modified power limit; and determine the minimum flow limit based on the modified power limit.

18. The machine of claim 14, wherein the controller is further configured to:

determine a maximum flow through the pump based on the engine speed and a maximum displacement of the pump;

determine a minimum displacement command limit as a ratio between the minimum flow limit and the maximum flow; and change the displacement of the pump by the minimum displacement command limit.

19. The machine of claim 14, wherein, when regulating the pump, the controller is further configured to change the displacement of the pump.

* * * * *